US010900444B2

(12) United States Patent
Dudar

(10) Patent No.: US 10,900,444 B2
(45) Date of Patent: Jan. 26, 2021

(54) METHODS AND SYSTEM FOR CONDUCTING AN ENGINE SYSTEM DIAGNOSTIC BASED ON AMBIENT NOISE

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 212 days.

(21) Appl. No.: 16/012,385

(22) Filed: Jun. 19, 2018

(65) Prior Publication Data

US 2019/0383239 A1 Dec. 19, 2019

(51) Int. Cl.
*F02M 25/08* (2006.01)
*F02D 41/00* (2006.01)

(52) U.S. Cl.
CPC ..... *F02M 25/0809* (2013.01); *F02D 41/0037* (2013.01); *F02M 25/0836* (2013.01); *F02D 2200/70* (2013.01)

(58) Field of Classification Search
CPC ..... F02M 25/0809; F02M 25/0836; F02D 41/0037; F02D 2200/70; F02D 41/0032
See application file for complete search history.

(56) References Cited

U.S. PATENT DOCUMENTS 7,437,274 B2 10/2008 Charette et al.
9,669,705 B2 6/2017 Pearce et al.
9,804,599 B2 * 10/2017 Kentley-Klay ..... B60Q 1/26
9,822,737 B2 11/2017 Dudar et al.
9,966,057 B1 * 5/2018 Wang ..... F02N 11/0814
10,508,618 B2 * 12/2019 Dudar ..... B60K 15/035
10,543,838 B2 * 1/2020 Kentley-Klay ..... G05D 1/0011
2017/0120804 A1 * 5/2017 Kentley ..... G05D 1/0088

OTHER PUBLICATIONS

Stewart, J., "Driverless Cars Need Ears as Well as Eyes," Wired Website, Available Online at http://www.wired.com/story/driverless-cars-need-ears-as-well-as-eyes/, Aug. 21, 2017, 10 pages.
Hannig, H., "HELLA and ebm-papst Drive Electrification," Epmpapst Press Release, Available Online at https://www.ebmpapst.com/en/press/press_releases/pressdetail_72576.php, Sep. 15, 2017, 1 page.

* cited by examiner

*Primary Examiner* — Freddie Kirkland, III
(74) *Attorney, Agent, or Firm* — Geoffrey Brumbaugh; McCoy Russell LLP

(57) ABSTRACT

Methods and systems are provided for conducting an engine diagnostic for a vehicle based on an amount of noise proximate to the vehicle. In one example, a method (or system) for a vehicle may include determining an ambient noise level surrounding the vehicle based on data received from autonomous vehicle sensors and conducting an engine diagnostic by operating a pump, motor, and/or actuators responsive to the determined ambient noise level. The engine diagnostic may be conducted while the vehicle is keyed off or while the engine is running and may be further conducted based on a proximity of human activity to the vehicle.

19 Claims, 6 Drawing Sheets

METHODS AND SYSTEM FOR CONDUCTING AN ENGINE SYSTEM DIAGNOSTIC BASED ON AMBIENT NOISE

FIELD

The present description relates generally to methods and systems for conducting an engine diagnostic for a vehicle based on an amount of noise proximate to the vehicle.

BACKGROUND/SUMMARY

Vehicle emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of leaks that could release fuel vapors to the atmosphere. In a typical leak test, a vacuum is applied to the fuel system. The integrity of the system is determined by monitoring the decay of the applied vacuum or by comparing the resulting fuel system pressure to an expected pressure. The vacuum source may be the intake manifold of the vehicle engine. However, in some vehicles, such as hybrid vehicles, the vehicle engine may not run frequently, or may not generate enough vacuum to conduct a leak test. Such vehicles may include an evaporative leak check module (ELCM) coupled to the fuel system. The ELCM includes a vacuum pump that can be coupled to the fuel system for leak testing. When applying a vacuum to the fuel tank, fuel vapors may be drawn into the fuel vapor canister. Such diagnostic tests may be performed after engine key-off, after a duration of vehicle soak time, or during engine operation.

One example approach of utilizing a pump of an ELCM to execute an evaporative emissions system diagnostic is shown by Dudar et al. in U.S. Pat. No. 9,822,737. Therein, a pump is used to conduct an evaporative emissions test diagnostic during a key-off event.

However, the inventors herein have recognized potential issues with such systems. As one example, the pump(s), servo motor(s), and/or actuators utilized during running the evaporative emissions system diagnostic may generate audible noise that may be undesirable to a driver of the vehicle or people in an area surrounding the vehicle. For example, if the vehicle is parked with the engine off, in a garage or driveway, one or more people in the vicinity of the vehicle may hear the noise generated during the evaporative emissions system diagnostic. Additionally, even when the engine is on and the vehicle is driving, it may be difficult to mask the noise generated by the equipment (pump, servo motor, and/or actuators) used to execute the diagnostic. Additional engine diagnostics (such as diagnostics for ratch throttle, eWG, and EGR) may utilize pump(s), servo motor(s), and/or additional actuators that create undesirable, audible noise during vehicle on (and engine running in some examples) or vehicle-off (and engine off) conditions.

In one example, the issues described above may be addressed by a method for a vehicle, comprising: receiving data from autonomous vehicle sensors; determining an ambient noise level surrounding the vehicle based on the received data; and conducting an evaporative emissions diagnostic (or alternate engine diagnostic), including operating one or more of a pump and servo motor of the vehicle, responsive to the determined ambient noise level. In this way, users of a vehicle inside the vehicle or in an area of the vehicle when parked may not hear or be irritated by the noise generated during conducting the evaporative emissions diagnostic. As a result, user satisfaction may be increased.

As one example, the diagnostic may only be executed when the determined ambient noise level surrounding the vehicle (e.g., within a threshold distance of the vehicle) is above a threshold level when human activity is detected around the vehicle when parked and the engine is off. The threshold may be predetermined and based on an amount of noise generated by the diagnostic equipment (e.g., pump, servo motor, and/or actuators) used to conduct the evaporative emissions (or alternate) diagnostic. If human activity is not detected, the diagnostic may run as scheduled. In another example, if the vehicle is being driven, the diagnostic may only be executed when a sum of the ambient noise level surrounding the vehicle and internal noise within the vehicle is greater than the threshold. Further, the autonomous vehicle sensors may include various cameras and a microphone of an autonomous vehicle, which may be the vehicle in which the diagnostic is conducted or an autonomous vehicle parked or driving proximate to the vehicle in which the diagnostic is conducted. In this way, audible noise generated during running the diagnostic (e.g., evaporative emissions diagnostic of the evaporative emissions system of an engine of the vehicle) may be reduced and user (e.g., driver or vehicle owner) satisfaction may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
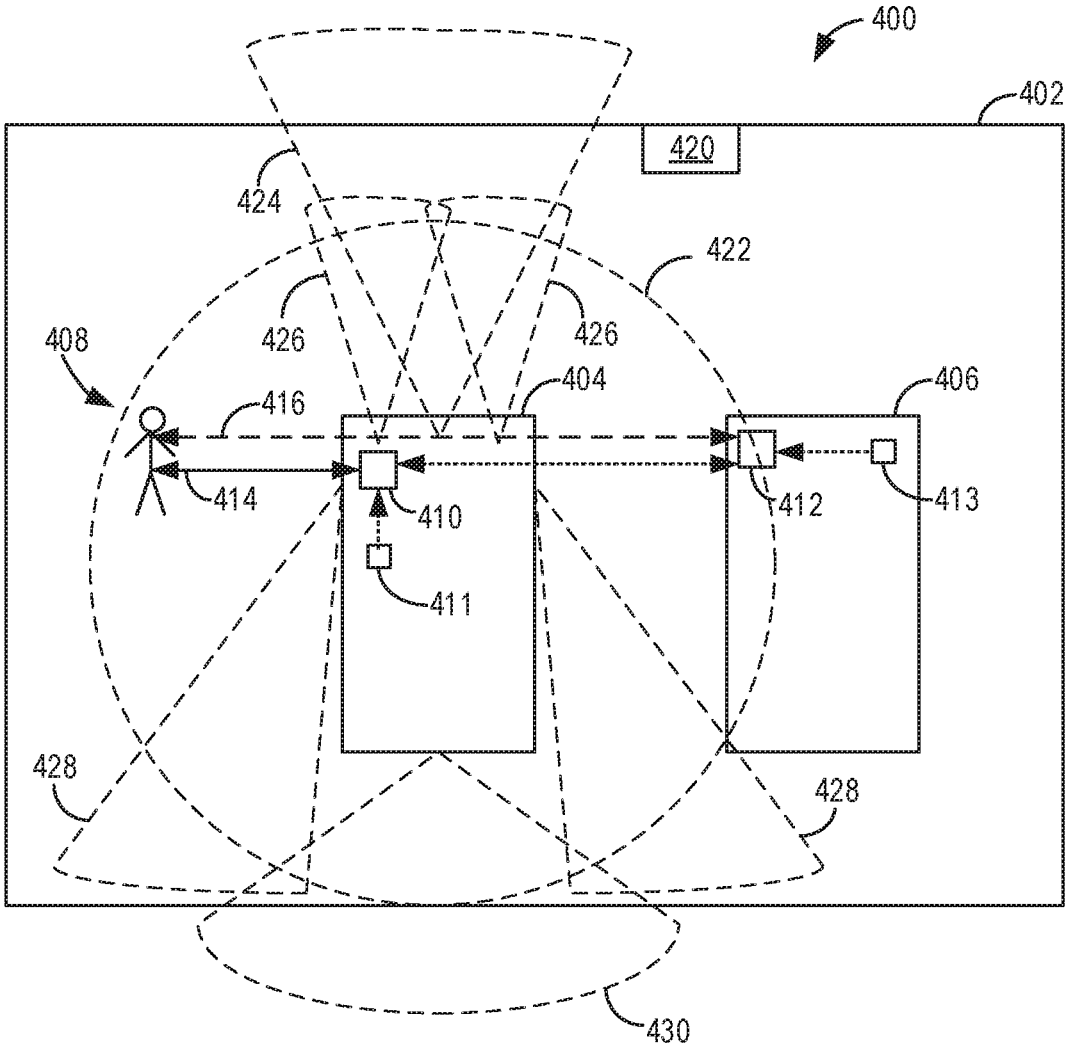
FIG. 4 schematically shows determination of human proximity to a vehicle for conducting an engine diagnostic.
Figure 5:
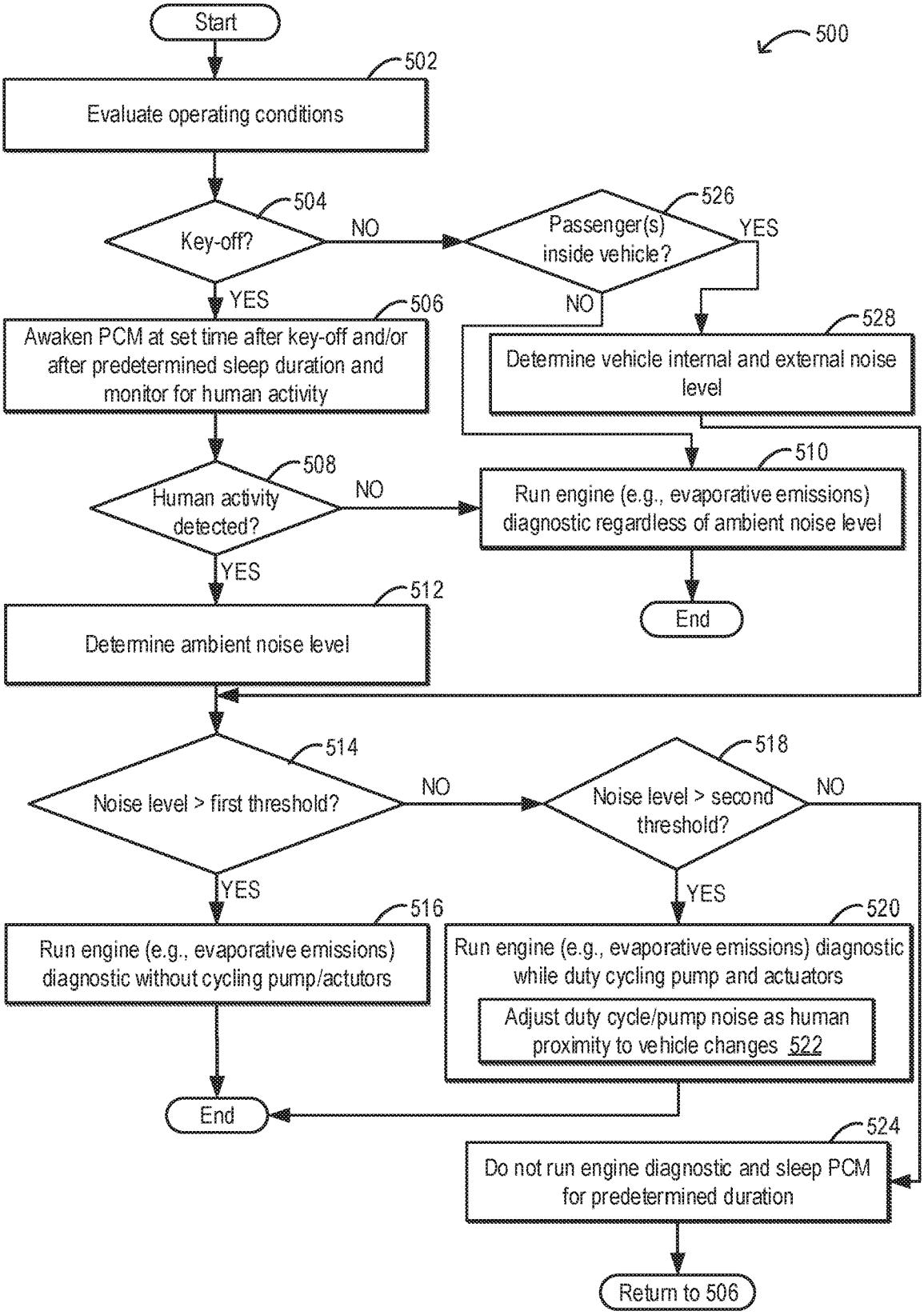
FIG. 5 shows a flow chart of a method for executing an engine diagnostic of a vehicle based on an ambient noise level estimate and/or human proximity to the vehicle.
Figure 6:
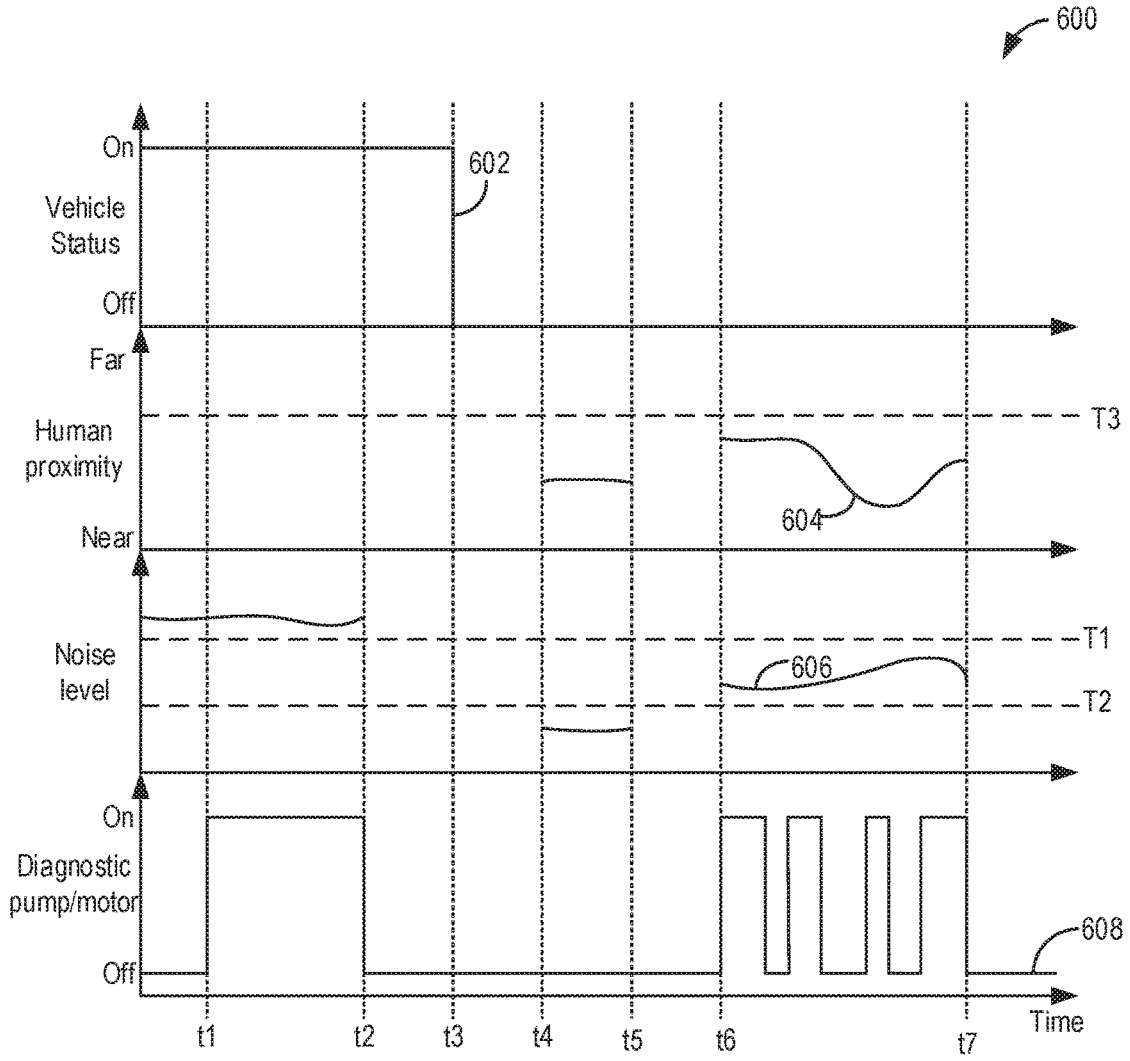
FIG. 6 shows a graph of example adjustments to operation of diagnostic equipment used to execute an engine diagnostic of a vehicle based on an ambient noise level.

The following description relates to systems and methods for conducting an engine diagnostic (e.g., diagnostic routine) for a vehicle based on an ambient noise level proximate to the vehicle. The vehicle may include an engine, a fuel system, and a control system, such as the vehicle shown in FIG. 1. The engine of the vehicle may include an evaporative emissions system, such as the system shown in FIG. 2, which may be checked periodically for leaks using various pumps, servo motors, and/or actuators. However, this equipment used for diagnostic tests during vehicle running or off conditions may generate audible noise that is undesirable to a driver or owner of the vehicle and/or humans in close proximity to the vehicle. For example, an evaporative emissions system diagnostic may be performed while the vehicle is parked and the engine has been turned off for a duration, such as when the vehicle is parked in a garage. However, as shown in FIG. 4, a human may be in the garage and positioned within a threshold distance of the vehicle. As a result, they may hear the noise generated during running of the engine diagnostic and be dissatisfied with this noise. However, if ambient noise surrounding the vehicle, such as in the garage, is louder than the noise generated by the equipment used to run the engine diagnostic, the human proximate to the vehicle may not notice or be bothered by the diagnostic equipment noise. Thus, a controller of an engine of the vehicle may determine when to execute the desired engine diagnostic and operate the equipment for running the diagnostic based on a determination of ambient noise surrounding the vehicle, as shown by the method of FIG. 5. In one example, the ambient noise estimate may be determined from sensors (e.g., cameras, microphone, etc.) of an autonomous vehicle, such as the autonomous vehicle system shown in FIG. 3. The autonomous vehicle may be the vehicle in which the diagnostic is being executed or a vehicle parked (or driving) proximate to the vehicle in which the diagnostic is being executed. Example conditions for executing the engine diagnostic based on noise surrounding the vehicle are shown in FIG. 6. In this way, engine diagnostics that generate noise by running one or more of a pump, servo motor, or actuators may be run only at times where the generated noise may not be noticed by a user (e.g., when ambient noise is greater than the diagnostic generated noise). As a result, user satisfaction may be increased.

Figure 1:
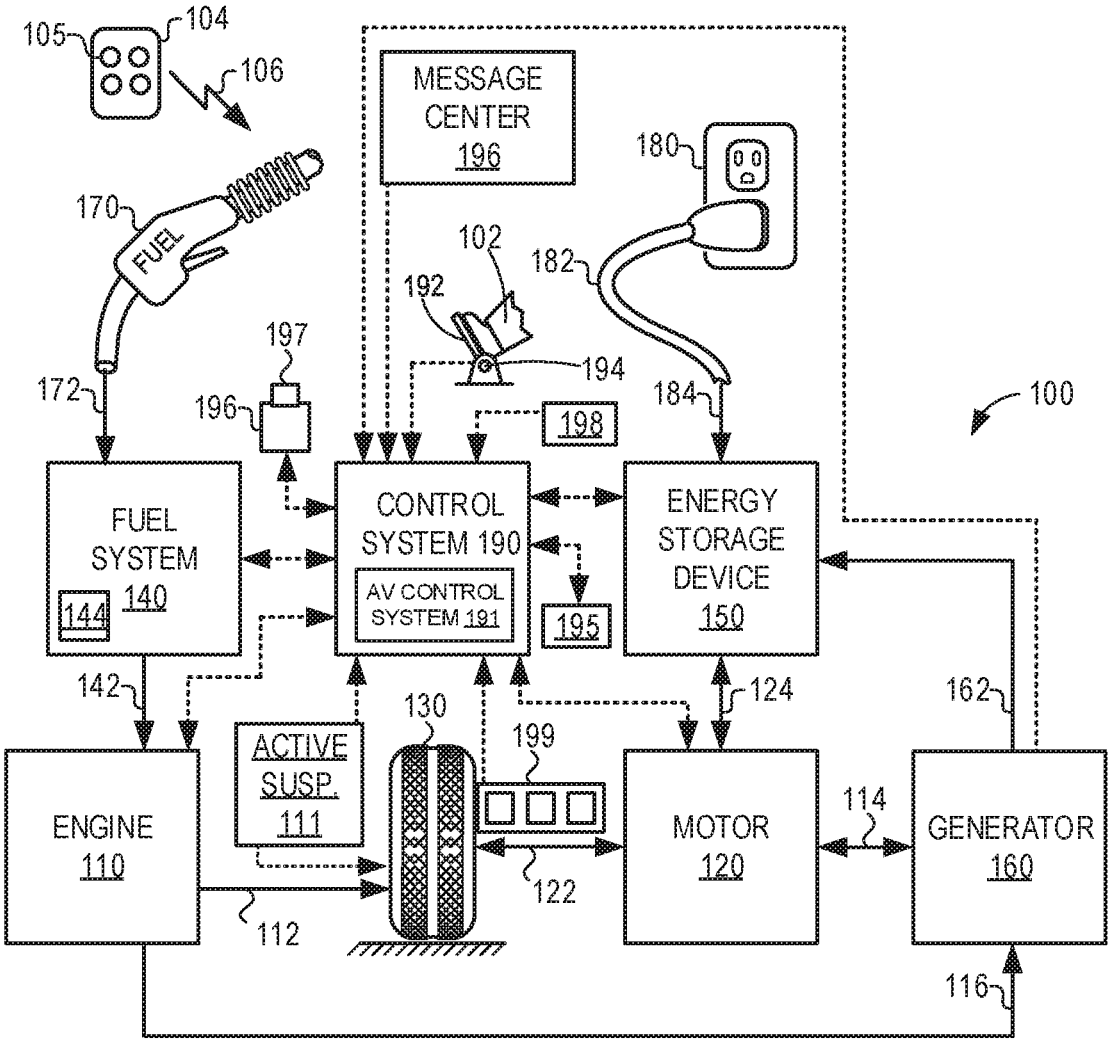
FIG. 1 schematically shows an example vehicle propulsion system.

Turning now to FIG. 1, it illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (e.g., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge an energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, a generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130, as indicated by arrow 112, while motor 120 is deactivated. During other operating conditions, both engine 110 and motor 120 may each be operated to propel the vehicle via drive wheel 130, as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130, as indicated by arrow 122. For example, during select operating conditions, engine 110 may drive generator 160, as indicated by arrow 116, which may in turn supply electrical energy to one or more of motor 120, as indicated by arrow 114, or energy storage device 150, as indicated by arrow 162. As another example, engine 110 may be operated to drive motor 120, which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110, as indicated by arrow 142. Still other suitable fuels or fuel blends may be supplied to engine 110, where they may be combusted at the engine to produce an engine output. The engine output may be utilized to propel the vehicle, as indicated by arrow 112, or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

A control system 190 may communicate with one or more of engine 110, motor 120, fuel system 140, energy storage device 150, and generator 160. For example, control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from a pedal position sensor 194 which communicates with a pedal 192.

Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone or smartphone-based system where a user's cellular telephone sends data to a server and the server communicates with the vehicle to start the engine.

In the case of an autonomous vehicle (AV), operator 102 may be substituted prior to the start of or en route during a specified trip by an autonomous vehicle control system 191 included within control system 190. In other words, the AV control system may provide indications and/or requested output of the vehicle propulsion system 100 to the control system 190. Control system 190, in accordance with the AV control system requests, then actuates various vehicle actuators to propel the vehicle. In the case of an AV, the vehicle system 100 may include various devices for detecting vehicle surroundings, such as radar, sonar, laser light, GPS, odometry, microphones, and computer vision sensors (e.g., cameras). Advanced control systems, as part of the AV control system, may interpret sensory information to identify appropriate navigation paths, as well as obstacles and relevant signage (e.g., speed limits, traffic signals, and the like). The AV control system may further include executable instructions that are capable of analyzing sensory data to distinguish between different vehicles on the road, which can aid in planning a path to the desired destination. For example, the AV control system may include executable instructions to detect a type of roadway (e.g., one-way street, freeway, divided highway, and the like), or an available parking space (e.g., an empty space with enough clearance for the vehicle that is not prohibited based on time of day or loading zone, and the like). Furthermore, the AV control system 191 may include executable instructions to, in combination with sensory feedback, park a vehicle in a designated or detected available parking space.

Energy storage device 150 may periodically receive electrical energy from a power source 180 residing external to the vehicle (e.g., not part of the vehicle), as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170, as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198 and an active suspension system 111 that enables the control system 190 to regulate vertical positioning of the vehicle wheels 130 relative to the vehicle body. Active suspension system 111 may comprise an active suspension system having hydraulic, electrical, and/or mechanical devices, as well as active suspension systems that control the vehicle height on an individual corner basis (e.g., four corner independently controlled vehicle heights), on an axle-by-axle basis (e.g., front axle and rear axle vehicle heights), or a single vehicle height for the entire vehicle. Vehicle propulsion system 100 may also include inertial sensors 199. Inertial sensors may comprise one or more of the following: longitudinal, latitudinal, vertical, yaw, roll, and pitch sensors. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197, which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or wheel brakes to increase vehicle stability in response to sensor(s) 199.

Figure 2:
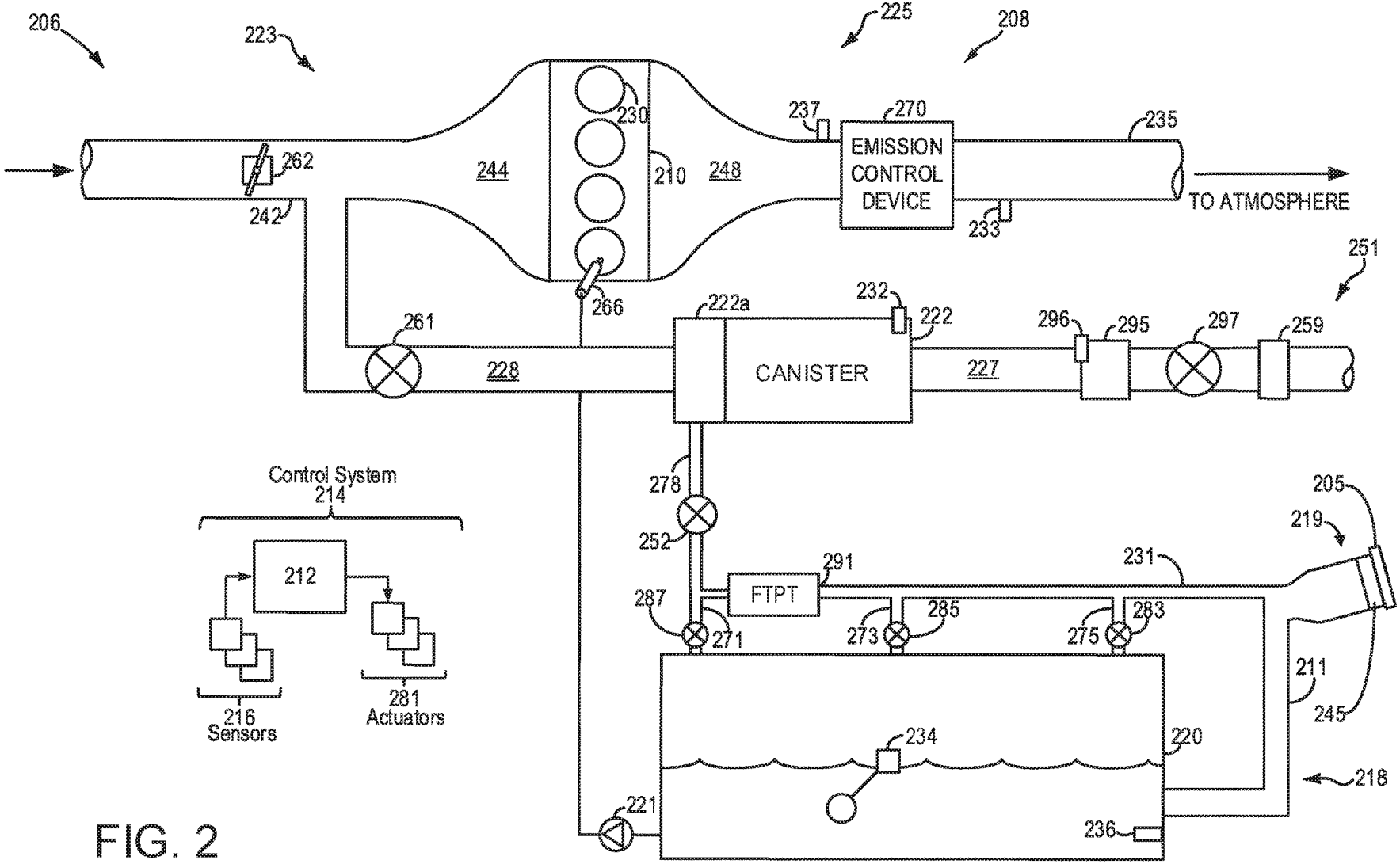
FIG. 2 schematically shows an example vehicle system with a fuel system and an evaporative emissions system.

FIG. 2 shows a schematic depiction of a vehicle system 206, which may be or be part of the vehicle propulsion system 100 shown in FIG. 1. The vehicle system 206 includes an engine system 208 coupled to an evaporative emissions control system 251 and a fuel system 218. Evaporative emissions control system 251 includes a fuel vapor container or canister 222, which may be used to capture and store fuel vapors. In some examples, vehicle system 206 may be a hybrid electric vehicle system.

The engine system 208 may include an engine 210 having a plurality of cylinders 230. The engine 210 includes an engine intake 223 and an engine exhaust 225. The engine intake 223 includes a throttle 262 fluidly coupled to an engine intake manifold 244 via an intake passage 242. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NOx trap, diesel particulate filter, oxidation catalyst, etc. It will be appreciated that other components may be included in the engine system 208, such as a variety of valves and sensors.

Fuel system 218 may include a fuel tank 220 coupled to a fuel pump system 221. The fuel pump system 221 may include one or more pumps for pressurizing fuel delivered to fuel injectors of engine 210, such as an example injector 266 shown. While only a single injector 266 is shown, additional injectors are provided for each cylinder. All the injectors in the example shown in FIG. 2 inject fuel directly into each cylinder (e.g., direct injection) rather than injecting fuel into or against an intake valve of each cylinder (e.g., port injection), however multiple fuel injector configurations are possible without departing from the scope of the present disclosure. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to a controller 212. As depicted, fuel level sensor 234 may comprise a float connected to a variable resistor. Alternatively, other types of fuel level sensors may be used. In some examples, a temperature sensor 236 is positioned within fuel tank 220, to measure fuel temperature. Though only one temperature sensor 236 is shown, multiple sensors may be employed. In some examples, an average of the temperature values detected by those sensors can be taken to obtain a more precise measure of the temperature within the interior of the fuel tank 220. All such temperature sensors are configured to provide an indication of fuel temperature to controller 212.

Vapors generated in fuel system 218 may be routed to the evaporative emissions control system (also referred to herein as an evaporative emissions system or EVAP system) 251, which includes fuel vapor canister 222 coupled to fuel system 218 via vapor recovery line 231, before being purged to the engine intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves may be arranged in conduits 271, 273, or 275. Among other functions, fuel tank vent valves may allow the fuel vapor canister of the evaporative emissions control system to be maintained at a low pressure or vacuum without increasing a fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include a refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. The fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Evaporative emissions control system 251 may include one or more emissions control devices, such as one or more fuel vapor canisters 222 filled with an appropriate adsorbent, that are configured to temporarily trap fuel vapors (including vaporized hydrocarbons) during fuel tank refilling operations and "running loss" vapors (that is, fuel vaporized during vehicle operation). In one example, the adsorbent used is activated charcoal. Emissions control system 251 may further include a canister ventilation path or vent line 227, which may route gases out of the canister 222 to the atmosphere when storing, or trapping, fuel vapors from fuel system 218.

Canister 222 may include a buffer **222*a* (or buffer region), each of the canister and the buffer comprising the adsorbent. As shown, the volume of buffer 222*a* may be smaller than (e.g., a fraction of) the volume of canister 222. The adsorbent in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222**. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via a purge line 228 and a purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 297 coupled within vent line 227. When included, the canister vent valve may be a normally open valve, so that a fuel tank isolation valve 252 (FTIV), if included, may control venting of fuel tank 220 with the atmosphere. FTIV 252, when included, may be positioned between the fuel tank and the fuel vapor canister within a conduit 278. FTIV 252 may be a normally closed valve that, when opened, allows for the venting of fuel vapors from fuel tank 220 to canister 222. Fuel vapors may then be vented to atmosphere or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open isolation valve 252, if included, while closing canister purge valve (CPV) 261 to direct refueling vapors into canister 222 while preventing fuel vapors from being directed into the intake manifold.

As another example, the fuel system may be operated in a refueling mode (e.g., when fuel tank refueling is requested by a vehicle operator), wherein the controller 212 may open isolation valve 252, if included, while maintaining canister purge valve 261 closed to depressurize the fuel tank before enabling fuel to be added therein. As such, isolation valve 252, if included, may be kept open during the refueling operation to allow refueling vapors to be stored in the canister. After refueling is completed, the isolation valve, if included, may be closed.

As yet another example, the fuel system may be operated in a canister purging mode (e.g., after an emission control device light-off temperature has been attained and with the engine running), wherein the controller 212 may open canister purge valve 261 while closing isolation valve 252, if included. Herein, the vacuum generated by the intake manifold of the operating engine may be used to draw fresh air through vent line 227 and through fuel vapor canister 222 to purge the stored fuel vapors into intake manifold 244. In this mode, the purged fuel vapors from the canister are combusted in the engine. The purging may be continued until the stored fuel vapor amount in the canister is below a threshold.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include an exhaust gas sensor 237 located upstream of the emission control device, a temperature sensor 233 coupled to exhaust passage 235, temperature sensor 236, a fuel tank pressure sensor (or pressure transducer) 291, and canister temperature sensor 232. Exhaust gas sensor 237 may be any suitable sensor for providing an indication of exhaust gas air/fuel ratio, such as a linear oxygen sensor or UEGO (universal or wide-range exhaust gas oxygen), a two-state oxygen sensor or EGO, a HEGO (heated EGO), a NOx, a HC, or a CO sensor. Other sensors, such as pressure, temperature, and composition sensors, may be coupled to various locations in the vehicle system 206. As another example, the actuators may include fuel injector 266, throttle 262, fuel tank isolation valve 252 (if included), canister vent valve 297, canister purge valve 261, and refueling lock 245. The control system 214 may include the controller 212. The controller may receive input data from the various sensors, process the input data, and trigger the actuators in response to the processed input data based on instruction or code programmed therein corresponding to one or more routines. An example control routine is described herein with regard to FIG. 5.

In some examples, the controller may be placed in a reduced power mode or sleep mode, wherein the controller maintains essential functions only and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode. Alternatively, the awake mode may be automatically triggered, via the wake input, after a duration of vehicle soak time (e.g., a duration after key-off).

Evaporative emissions detection routines may be intermittently performed by controller 212 on fuel system 218 and evaporative emissions control system 251 to confirm that the fuel system and/or evaporative emissions control system are not compromised. As such, evaporative emissions detection routines (also referred to herein as evaporative emissions diagnostics) may be performed while the engine is off (engine-off evaporative emissions test) using engine-off natural vacuum (EONV) generated due to a change in temperature and pressure at the fuel tank following engine shutdown and/or with vacuum supplemented from a vacuum pump. Alternatively, evaporative emissions detection routines may be performed while the engine is running by operating a vacuum pump and/or using engine intake manifold vacuum. Evaporative emissions tests may be performed by an evaporative level check monitor (ELCM) 295 communicatively coupled to controller 212. ELCM 295 may be coupled in vent 227, between canister 222 and the atmosphere. ELCM 295 may include a vacuum pump for applying negative pressure to the fuel system when administering an evaporative emissions test. In some embodiments, the vacuum pump may be configured to be reversible. In other words, the vacuum pump may be configured to apply either a negative pressure or a positive pressure on the fuel system. ELCM 295 may further include a reference orifice and a pressure sensor 296. Following the application of vacuum to the fuel system, a change in pressure at the reference orifice (e.g., an absolute change or a rate of change) may be monitored and compared to a threshold. Based on the comparison, fuel system degradation may be diagnosed. In another approach, the negative pressure may be applied by coupling the vacuum pump to canister vent line 227. As described further below, the vacuum pump of ELCM 295 may generate noise during the evaporative emissions tests (e.g., diagnostics) which is audible to a vehicle driver or human located within a threshold distance of the vehicle.

In some configurations, the canister vent valve (CVV) 297 coupled within vent line 227 may function to adjust a flow of air and vapors between canister 222 and the atmosphere. The CVV may also be used for diagnostic routines. When included, the CVV may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 297 may be a solenoid valve wherein opening or closing of the valve is performed via actuation of a canister vent solenoid. In particular, the canister vent valve may be a normally open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, then opened at a later time point with another 100 ms pulse. In this way, the amount of battery power required to maintain the CVV closed is reduced. In particular, the CVV may be closed while the vehicle is off, thus maintaining battery power while maintaining the fuel emissions control system sealed from atmosphere.

Figure 3:
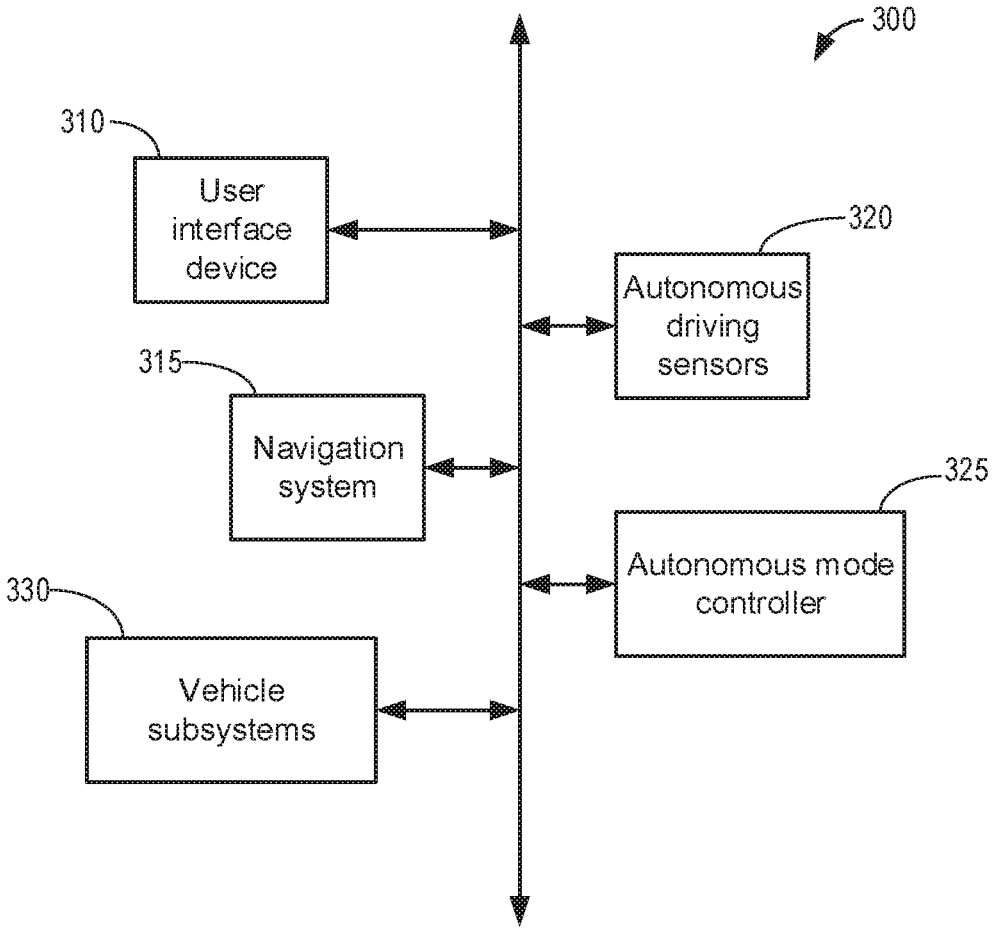
FIG. 3 schematically shows a block diagram of an example autonomous driving system.

FIG. 3 is a block diagram of an example autonomous driving system 300 that may operate the vehicle propulsion system 100, described above at FIG. 1, which may include an engine system, such as the engine system 208 of FIG. 2. Herein, the vehicle propulsion system 100 will be referred to simply as a "vehicle". The autonomous driving system 300, as shown, includes a user interface device 310, a navigation system 315, at least one autonomous driving sensor 320, and an autonomous mode controller 325.

The user interface device 310 may be configured to present information to vehicle occupants, under conditions wherein a vehicle occupant may be present. However, it may be understood that the vehicle may be operated autonomously in the absence of vehicle occupants, under certain conditions. The presented information may include audible information or visual information. Moreover, the user interface device 310 may be configured to receive user inputs. Thus, the user interface device 310 may be located in the passenger compartment (not shown) of the vehicle. In some possible approaches, the user interface device 310 may include a touch-sensitive display screen.

The navigation system 315 may be configured to determine a current location of the vehicle using, for example, a Global Positioning System (GPS) receiver configured to triangulate the position of the vehicle relative to satellites or terrestrial-based transmitter towers. The navigation system 315 may be further configured to develop routes from the current location to a selected destination, as well as display a map and present driving directions to the selected destination via, for example, the user interface device 310.

The autonomous driving sensors 320 may include any number of devices configured to generate signals that help navigate the vehicle. Examples of autonomous driving sensors 320 may include a radar sensor, a LIDAR sensor, a sonar sensor, a vision sensor (e.g. a camera), vehicle to vehicle infrastructure networks, one or more microphones, or the like. The autonomous driving sensors 320 may enable the vehicle to "see" and "hear" the roadway and vehicle surroundings, and/or negotiate various obstacles while the vehicle 100 is operating in autonomous mode. The autonomous driving sensors 320 may be configured to output sensor signals to, for example, the autonomous mode controller 325.

The autonomous mode controller 325 may be configured to control one or more subsystems 330 while the vehicle is operating in the autonomous mode. Examples of subsystems 330 that may be controlled by the autonomous mode controller 325 may include a brake subsystem, a suspension subsystem, a steering subsystem, and a powertrain subsystem. The autonomous mode controller 325 may control any one or more of these subsystems 330 by outputting signals to control units associated with subsystems 330. In one example, the brake subsystem may comprise an anti-lock braking subsystem, configured to apply a braking force to one or more of wheels (e.g., wheel 130 shown in FIG. 1). Discussed herein, applying the braking force to one or more of the vehicle wheels may be referred to as activating the brakes. To autonomously control the vehicle, the autonomous mode controller 325 may output appropriate commands to the subsystems 330. The commands may cause the subsystems to operate in accordance with the driving characteristics associated with the selected driving mode. For example, driving characteristics may include how aggressively the vehicle accelerates and decelerates, how much space the vehicle leaves behind a front vehicle, how frequently the autonomous vehicle changes lanes, etc.

The autonomous mode controller 325 may be AV control system 191 shown in FIG. 1. As such, the autonomous mode controller 325 may be included within a control system of the vehicle (e.g., control system 190 shown in FIG. 1 and/or control system 214 shown in FIG. 2) and may communicate data with a controller of the vehicle control system (e.g., controller 212 shown in FIG. 2). For example, as explained further below with reference to FIGS. 5 and 6, the autonomous mode controller 325 may obtain data (e.g., receive signals) from the autonomous driving sensors 320 (such as from the cameras and/or microphones) and transmit this data to the vehicle controller. The vehicle controller may then determine a proximity of one or more humans from the vehicle and/or an ambient noise level surrounding the vehicle. The vehicle controller may use this information to initiate the execution of one or more engine diagnostic tests (e.g., routines), such as an evaporative emissions diagnostic. Additionally, the autonomous mode controller 325 may include wireless capabilities that include sending and/or receiving data to/from a controller of a nearby vehicle. For example, the autonomous mode controller 325 may transmit data received from the autonomous driving sensors 320, via a wireless network connection, to the vehicle or engine controller of a second, non-autonomous or another autonomous vehicle parked or driving within a threshold distance (e.g., proximate to or close enough to transmit signals and detect noise and movement around the nearby vehicle) of the first, autonomous vehicle. In this way, ambient noise and human proximity information may be shared between vehicles located proximate to each other.

FIG. 4 shows a schematic 400 of a system for detecting human proximity to a vehicle.

Specifically, schematic 400 shows a first vehicle 404 and second vehicle 406 parked within a space 402. In one example, the space 402 may be a garage. In another example, the space 402 may be a driveway or parking lot. The first vehicle 404 includes a vehicle propulsion system, such as system 100 shown in FIG. 1, and includes a control system 410, which may be one or more of control system 190 shown in FIG. 1 and control system 214 shown in FIG. 2. The second vehicle 406 may be an autonomous vehicle that includes an autonomous driving system, such as autonomous driving system 300 shown in FIG. 3. Thus, second vehicle 406 includes a control system 412 which may include an autonomous mode controller (such as controller 325 shown in FIG. 3) that receives information from one or more autonomous driving sensors 413 (such as sensors 320 shown in FIG. 3) of vehicle 406, as shown by the dotted line between sensors 413 and control system 412. In some embodiments, the first vehicle 404 also includes an autonomous mode controller included in control system 410, which receives information from one or more autonomous driving sensors 411 (such as sensors 320 shown in FIG. 3). A human 408 is located within the space 402, proximate to first vehicle 404 and second vehicle 406.

In one example, the first vehicle 404 is an autonomous vehicle including an autonomous driving system (such as system 300 shown in FIG. 3). In this example, the control system 410, including one or more autonomous driving sensors 411 (which may include various navigations sensors including one or more cameras positioned around and coupled to the first vehicle 404), may detect that the human 408 is a first distance 414 from the first vehicle 404. Examples of a 360 degree camera system of the autonomous driving sensors is shown in FIG. 4, for the first vehicle (however, second vehicle 406 may include the same or similar system). The 360 degree camera system includes a plurality of cameras and allows the controller to detect human activity around an entirety of the vehicle (e.g., not just at the back or sides). Specifically, as shown in the example presented in FIG. 4, the coverage area of the plurality of cameras may cover an entirety of an outer perimeter of the vehicle, thereby enabling the autonomous driving sensors to detect human activity at any position surrounding the vehicle, within the coverage area. The coverage areas of a plurality of cameras (included in sensors 411) of an example 360 degree camera system of the first vehicle 404 (but may also be included in the second vehicle 406) is shown in FIG. 4 and includes coverage area 422 of a surround camera (which may, in one example, be used for parking assist, cross-traffic alert, and junction assist in an autonomous vehicle), coverage areas 424 and 426 of one or more forward cameras (which may, in one example, be used for adaptive cruise control, automatic emergency braking, forward collision warning, lane keep assist, adaptive front light control, and/or traffic sign recognition in an autonomous vehicle), coverage areas 428 and 430 of side and rear cameras, respectively (which may, in one example, be used for park assist, cross-traffic alert, junction assist, and/or mirror replacement in an autonomous vehicle). In alternate embodiments, the vehicle may include more or fewer cameras with different coverage areas, but that still cover an entirety of the outer perimeter of the vehicle, and a distance away from the vehicle.

In this way, the autonomous vehicle sensors may detect a human proximity to the first vehicle 404. In one example, the first distance 414 may be a threshold distance for running an engine diagnostic that generates noise (such as the evaporative emissions diagnostic test described above) based on an ambient noise level surrounding the first vehicle. In another example, the first distance 414 may be smaller than the threshold distance (and thus the human 408 is detected to be within a threshold distance of the first vehicle 404). As described further below with reference to FIG. 6, when human activity is detected within the threshold distance of the first vehicle 404, the engine diagnostic may only be run when ambient noise surrounding the vehicle is greater than a predetermined threshold level. The control system 410 of first vehicle 404 may determine (e.g., estimate) the ambient noise level surrounding (e.g., outside of and within space 402) the first vehicle 404 based on signals received from the autonomous driving sensors (e.g., from a microphone coupled to the vehicle and included as part of control system 410).

In another example, the first vehicle 404 may not be an autonomous vehicle and may not include cameras capable of detecting human activity proximate to first vehicle 404, but the second vehicle 406 may be an autonomous vehicle. In this example, the control system 410 of first vehicle 404 may receive, via a wireless network connection and wireless communication systems, data regarding the proximity of the human 408 from one or more of infrastructure camera(s) of an auxiliary monitoring system 420 and/or autonomous driving sensors (e.g., cameras) of the control system 412 of the second vehicle 406. Based on the received data at the control system 410 of the first vehicle 404, the controller of first vehicle 404 may determine the proximity of human 408 to the first vehicle 404. Further, the control system 412, including one or more autonomous driving sensors 413 (which may include various navigations sensors including one or more cameras positioned around and coupled to the second vehicle 406), may detect that the human 408 is a second distance 416 from the second vehicle 406 and determine the proximity of the human 408 from the first vehicle 404 and send this information to control system 410. The ambient noise level may then be determined based on outputs from a microphone of the control system 410 of the first vehicle 404 (if first vehicle 404 has a microphone) and/or outputs from a microphone of the auxiliary monitoring system 420 and/or control system 410 of the second vehicle 406 (e.g., if first vehicle 404 does not have a microphone or the microphone is degraded). The auxiliary monitoring system 420 may be a home security system or another type of camera having vision, sound, and/or wireless communication capabilities. In this way, the controller of control system 410 may receive signals from the various sensors of control system 410, control system 412, and/or auxiliary monitoring system 420 and employ the various actuators of the control system 410 (e.g., actuators 281 shown in FIG. 2, which may include one or more pumps, servo motors, and actuators used during an engine diagnostic test, such as an EVAP system diagnostic) to execute one or more engine diagnostic routines based on the received signals and according to instructions stored on memory of the controller of control system 410.

Turning now to FIG. 5, a method 500 for executing an engine diagnostic of a vehicle based on an ambient noise level estimate and/or human proximity to the vehicle is shown. The vehicle may include one or more of the vehicle systems disclosed herein (e.g., vehicle propulsion system 100 of FIG. 1, vehicle system 206 of FIG. 2, and/or autonomous driving system 300 of FIG. 3). Further, the vehicle system may include one or more controllers, such as a controller of control system 190 of FIG. 1, controller 212 of control system 214 of FIG. 2, and/or autonomous mode controller 325. Instructions for carrying out method 500 and the rest of the methods included herein may be executed by the controller based on instructions stored on a memory of the controller and in conjunction with signals received from sensors of the engine system, such as the sensors described above with reference to FIGS. 1-3. The controller may employ engine actuators of the engine system to adjust engine operation, according to the methods described below. In one embodiment, the vehicle in which the controller is installed may be an autonomous vehicle, as described above. In another embodiment, the vehicle may be a non-autonomous vehicle but may include a wireless communication system in the control system that may transmit and receive wireless signals from alternate electrical systems, such as a control system of a nearby autonomous vehicle or an auxiliary monitoring system (such as a security system).

Method 500 begins at 502 by evaluating operating conditions. Operating conditions may include an operating state of the engine (e.g., on or off), a state of the vehicle (e.g., driving, parked, etc.), ambient conditions (e.g., temperature, pressure, humidity), and one or more engine operating conditions (such as engine speed, engine load, engine temperature, etc.). At 504, the method includes determining whether the vehicle is in a key-off state (e.g., ignition key of the vehicle is turned off so the engine is turned off). In the key-off state, the vehicle may be parked and the engine is off. The controller may be placed in a sleep mode following a vehicle key-off event.

If the vehicle is keyed-off and the engine is not running, the method proceeds to 506 to awaken the controller (e.g., PCM) at a set time after key-off and/or after a predetermined sleep duration and then monitor for human activity. For example, the controller may be placed in a reduced power mode or sleep mode, wherein the controller maintains essential functions only and operates with a lower battery consumption than in a corresponding awake mode, directly after vehicle key-off. Then, at a set time or duration after key-off, which may be predetermined, the awake mode of the controller may be automatically triggered, resulting in the controller waking up and returning to a full power mode wherein a diagnostic routine may be executed via the controller. After awakening, the controller monitors the surroundings of the vehicle for human activity. Monitoring for human activity may include determining a proximity of human activity to the vehicle, determining whether any human activity (e.g., movement, noise, etc.) is detected by sensors of the vehicle or a nearby vehicle, and/or determining whether human activity is detected within a preset, threshold range (e.g., distance) of the vehicle (the vehicle in which the diagnostic is to be performed). In one embodiment, the controller may detect human activity using signals received from autonomous vehicle sensors. The autonomous vehicle sensors may be of the vehicle that is performing the diagnostic (if it is an autonomous vehicle and includes the autonomous vehicle sensors) or of an autonomous vehicle parked proximate to (e.g., within a second threshold distance, such as parked in a same garage or driveway) the vehicle in which the diagnostic is performed. Autonomous vehicle sensors may include one or more cameras, alternate vision sensors, radar sensor, LIDAR sensor, and/or microphones (such as the autonomous driving sensors 320 discussed above with reference to FIG. 3 and/or the autonomous driving sensors 411 and 413 discussed above with reference to FIG. 4). In an alternate embodiment, if the vehicle is not an autonomous vehicle, does not include multiple cameras capable of detecting human activity around an entirety of the vehicle, and/or there is no autonomous vehicle nearby the vehicle, then the controller may detect human activity using signals received from one or more infrastructure cameras of an auxiliary monitoring system. For example, as discussed above with reference to FIG. 4, the auxiliary monitoring system may be a home (or business) security system that includes one or more cameras positioned in a garage, driveway, and/or exterior of a house or building that may detect human activity proximate to the vehicle.

At 508, the method includes determining whether human activity is detected. As one example, the controller may receive signals from its own cameras (e.g., cameras or vision sensors positioned around a body, or exterior, of the vehicle), cameras from a nearby vehicle (via a vehicle-to-vehicle wireless network connection), and/or cameras from an auxiliary monitoring system (via a device-to-device wireless network connection). The controller may then process the received signals to determine a proximity (e.g., distance) of a human from the vehicle in which the diagnostic is to be performed. If the determined proximity is within a threshold distance (or proximity) to the vehicle (such as first distance 414 shown in FIG. 4), the controller may determine and indicate that human activity is detected. The threshold distance may be a predetermined distance that is based on a distance within which a human may hear the diagnostic routine running on the vehicle. In another example, the threshold distance may be the coverage range (e.g., distance) of the plurality of cameras or vision sensors. For example, the controller may receive signals from one or more of the cameras or vision sensors described above in response to the sensors detecting any human activity (e.g., presence, movement, and/or sound) within a coverage (e.g., sensing) area of the plurality of cameras or vision sensors.

If no human activity is detected around the vehicle, the method proceeds to 510 to run the engine diagnostic regardless of an ambient noise level (e.g., amount of ambient noise surrounding the vehicle). Running the engine diagnostic may include operating one or more pumps, servo motors, and/or actuators of the engine in order to execute the diagnostic and obtain diagnostic data. One example of such an engine diagnostic includes an evaporative emissions diagnostic (or test), as described above, which is used to diagnose one or more leaks in an evaporative emissions system, such as evaporative emissions control system 251 shown in FIG. 2. During the evaporative emissions diagnostic, a pump of an evaporative level check monitor (ELCM) (e.g., ELCM 295 shown in FIG. 2) may be operated. Running the engine diagnostic at 510 may also include operating the pump, but not cycling the pump (e.g., not turning it on/off at selected intervals during the diagnostic test) and allowing a maximum amount of noise output from the pump and/or additional diagnostic equipment (e.g., servo motors and actuators) since no human activity is detected (e.g., no humans around the vehicle to be bothered by the noise). Running the diagnostic in this fashion may expedite the time for the diagnostic, thereby allowing the controller to go back to sleep more quickly and further reduce the likelihood of a human being bothered by the noise generated from the diagnostic test. Method 500 may then end.

Alternatively at 508, if human activity is detected surrounding the exterior of the vehicle, the method proceeds to 512 to determine an ambient noise level surrounding the vehicle. In one example, determining the ambient noise level surrounding the vehicle may include determining an amount of noise directly surrounding the vehicle and within a threshold distance (which may be the same threshold distance as the distance discussed above with reference to 508) of the vehicle. In this way, the amount of ambient noise in a vicinity of the detected human activity may be determined. Additionally, ambient noise may be noise exterior to (and not made by) the vehicle, in an area proximate to the vehicle. The controller may determine the ambient noise level based on signals received from a microphone of the vehicle, a microphone of a vehicle arranged (e.g., parked) proximate to the vehicle in which the diagnostic is to be performed, and/or a microphone of an auxiliary monitoring system (as described above). The microphone may be included on an exterior of the vehicle or exterior to the passenger cabin of the vehicle which is exposed to exterior, ambient noise. For example, the controller may receive an output from one or more of the microphones described above and determine the ambient noise level surrounding the vehicle from the output (e.g., a level of ambient noise level in dB).

At 514, the method includes determining whether the noise level determined at 512 (e.g., ambient noise level) or determined at 528 (internal and external noise level, as discussed further below) is greater than a first threshold. In one example, the first threshold may be based on a predetermined noise level of the diagnostic equipment used to run the selected engine diagnostic when the diagnostic equipment noise is not limited (e.g., run or operated without being cycled on and off to reduce noise). Specifically, in one example, the first threshold may be greater than the predetermined diagnostic equipment noise level (e.g., a threshold amount plus the predetermined diagnostic equipment noise level, where the threshold amount is a non-zero amount). As discussed above, the diagnostic equipment may be one or more pumps, servo motors, and actuators that are operated during the engine diagnostic and create audible noise. If the determined noise level is greater than the predetermined first threshold, then the method proceeds to 516 to run the engine (e.g., evaporative emissions) diagnostic without cycling the pump/motor/actuators (e.g., diagnostic equipment). In this way, the engine diagnostic may only be executed, without limiting the noise produced by the diagnostic equipment, if the determined noise level is a threshold amount greater than the first threshold. This may ensure that a human proximate to the vehicle does not hear, or is not bothered by, the noise generated during execution of the diagnostic at 516. In one example, running the engine diagnostic at 516 may include turning on and operating one or more pumps, motors, and actuators according to diagnostic test instructions stored in a memory of the controller. For example, as described above with reference to FIG. 2, running an evaporative emissions diagnostic (or test) may include operating a vacuum pump (such as the vacuum pump of ELCM 295 shown in FIG. 2) to apply negative pressure to the fuel system. Specifically, running the evaporative emissions diagnostic without cycling pump/actuators may include operating the vacuum pump continuously, without cycling the pump on/off to reduce noise (as described further below with reference to 520). Executing the evaporative emissions diagnostic may further include operating (e.g., actuating) one or more actuators, such as a canister vent valve (e.g., CVV 297 shown in FIG. 2). Following 516, method 500 may end.

Returning to 514, if the determined noise level is not greater than the first threshold, the method continues to 518 to determine whether the determined noise level is greater than a second threshold. The second threshold is less than the first threshold. In one example, the second threshold may be based on the predetermined noise level of the diagnostic equipment used to run the selected engine diagnostic when the diagnostic equipment noise is not limited (e.g., run or operated without being cycled on and off to reduce noise). Specifically, in one example, the second threshold may be approximately the predetermined diagnostic equipment noise level. If the determined noise level is greater than the second threshold, the method continues to 520 to run the engine (e.g., evaporative emissions) diagnostic while duty cycling the pump and/or actuators used to execute the diagnostic. Duty cycling the pump and/or actuators may include turning the pump and/or actuators on and off at a set duty cycle (e.g., on/off rate or timing). For example, by cycling the on/off status of the pump during executing the evaporative emissions diagnostic, the amount of noise produced by the pump may be reduced to a level that is tolerable or less noticeable by the human(s) proximate to the vehicle during the test. The method at 520 may further include, as shown at 522, adjusting the duty cycle of the pump and/or actuators, during the execution of the engine diagnostic routine, as human proximity to the vehicle changes. For example, the controller may continuously monitor human activity proximate to the vehicle, as discussed above at 506 and 508, and determine the proximity of the human activity to the vehicle (e.g., the distance of the detected human activity from the vehicle). As the distance between the detected human activity and the vehicle decreases, the controller may adjust the duty cycle so that the pump off time is greater than the pump on time and/or so that the rate of cycling the pump increases so that the noise produced by the pump and/or actuators decreases. This may result in reduced audible noise during running of the diagnostic, but a longer overall run time for the engine diagnostic.

For example, at 522, the controller may determine the human proximity to the vehicle using signals received from the one or more cameras and/or vision sensors discussed above and then determine the pump (and/or actuator and/or motor) duty cycle based on the determined human proximity. For example, the controller may determine a control signal to send to the pump (or motor or actuator), such as a duty cycle of the signal being determined based on a determination of the human proximity to the vehicle. The controller may determine the duty cycle through a determination that directly takes into account a determined human proximity to the vehicle, such as increasing the duty cycle with decreasing human proximity to the vehicle. The controller may alternatively determine the duty cycle based on a calculation using a look-up table with the input being human proximity and the output being duty cycle. As another example, the controller may make a logical determination (e.g., regarding the duty cycle of the pump) based on logic rules that are a function of the human proximity to the vehicle. The controller may then generate a control signal that is sent to an actuator of the pump (or motor or alternate actuator). The method may then end.

Returning to 518, if the determined noise level is not greater than the second threshold, the method continues to 524 to not run the engine (e.g., evaporative emissions) diagnostic and instead sleep the PCM (e.g., operate the controller in the sleep mode described above) for a predetermined duration. After expiration of the predetermined duration, the method may return to 506.

Returning to 504, if the vehicle is not in the key-off state (and thus may be on with the engine running), the method continues to 526 to determine whether a passenger is inside the vehicle. The controller may receive signals from one or more sensors inside the vehicle (e.g., inside a passenger cabin of the vehicle), which may be included as the one or more autonomous driving sensors 320 of FIG. 3 and/or the sensors 216 of FIG. 2, such as an internal camera, weight sensor, etc., and determine whether there is a passenger in the vehicle based on the received sensor signals. In one example, if the vehicle is an autonomous vehicle, it may be capable of driving without a passenger, and a passenger may not be present inside the vehicle. If this is the case, the method continues to 510 to run the engine diagnostic regardless of ambient noise level (and without limiting pump or motor or actuator noise during execution of the diagnostic), as described above. Alternatively at 526, if there is a passenger detected within the vehicle, the method proceeds to 528 to determine a vehicle internal and external noise level. Determining the external noise level may include determining the ambient noise level (e.g., noise external to or outside of the vehicle), as discussed above with reference to 512. Determining the internal noise level may include using one or more sensors positioned inside the vehicle (e.g., inside the passenger compartment), such as a microphone, to estimate the internal noise level of the vehicle passenger cabin (e.g., the level of noise heard from within the vehicle passenger cabin). The microphone may be one of the autonomous driving sensors described herein (such as those described above with reference to FIGS. 3 and 4). The controller may then determine the combined internal and external noise level (by summing the ambient noise level and internal noise level) and the method may then continue to 514, as described above.

Turning now to FIG. 6, a graph 600 of example adjustments to operation of diagnostic equipment used to execute an engine diagnostic of a vehicle based on an ambient noise level is shown. Specifically, graph 600 shows changes in vehicle status at plot 602, where "on" indicates the vehicle is keyed on and the engine may be running and "off" indicates where the vehicle is keyed off and the engine is off (e.g., vehicle may be parked). Graph 600 also shows changes in human proximity to the vehicle (e.g., a distance between detected human activity and the vehicle) at plot 604, changes in a noise level surrounding the vehicle at plot 606, and changes in operation (e.g., on/off) of diagnostic equipment used during execution of an engine diagnostic (such as a pump, servo motor, or actuator) at plot 608. The noise level shown at plot 606 may be either an ambient noise level (e.g., when the vehicle is in a key-off state), as described herein, or internal and external noise of the vehicle (e.g., ambient noise outside the vehicle plus internal noise inside the vehicle, when the vehicle is running and the engine may be running). As described above, the ambient noise level and internal noise level of the vehicle, and also the human proximity estimate, may be determined from outputs of autonomous vehicle sensors, or from auxiliary monitoring systems (such as sensors of a home security system). The diagnostic equipment may include various pumps, servo motors, and actuators that create audible noise to a human proximate to the vehicle when executing an engine diagnostic routine. In one example, the diagnostic equipment may be a vacuum pump that is operated during running of an evaporative emissions diagnostic test, and changes in the pump operation may include the pump being operated "on" or "off". For example, the pump may be operated in a continuously "on" state where it is continuously pumping or in a cycled state where it cycles between "on" and "off". In this way, when it is cycling, it may still be in operation, but it may not be pumping and creating noise while it is in the "off" state. The thresholds shown at plots 604 and 606 (T1, T2, and T3) may be similar to the thresholds described above with reference to FIG. 5. Further, these thresholds may be non-zero, positive values.

Prior to time t1, the vehicle is on and the engine may be operating (plot 602). At time t1, it may be time for running an engine diagnostic routine, such as an evaporative emissions diagnostic (as described herein) which requires running a pump (however, alternate diagnostics may utilize different diagnostic equipment such as servo motors and/or actuators that produce audible noise). The controller determines a level of noise inside and outside the vehicle (ambient noise plus internal vehicle noise, e.g., noise inside the passenger cabin of the vehicle) and compares this to predetermined thresholds, T1 and T2. Since the determined noise level is greater than the first threshold T1 at time t1 (plot 606), the desired engine diagnostic is executed without limiting the noise produced by the pump (e.g., without cycling the pump on and off during operation). Specifically, the pump (or motor or actuator in alternate engine diagnostic routines) is turned on and operated continuously at t1, until the routine concludes at time t2, without cycling the pump on/off (plot 608).

At time t3, the vehicle stops and is put into a key-off state (e.g., the vehicle is turned off and may be parked) (plot 602). After a duration of soak time (e.g., a duration after key-off), at time t4, the controller is woken from a sleep state in order to run an engine diagnostic (such as the evaporative emission diagnostic described herein), if conditions allow for the diagnostic. At time t4, the controller detects, based on signals received from one or more autonomous vehicle sensors, human activity within a threshold distance T3 of the vehicle (plot 604). Specifically, the detected distance between the human activity and the vehicle is less that the threshold distance T3 at time t4. Additionally, at time t4, the noise level (ambient noise level since the vehicle is keyed off) is less than both the first threshold T1 and second threshold T2 (plot 606). In response to detecting human activity within the threshold distance T3 while ambient noise is less than the second threshold T2, the controller maintains the pump off and does not run the engine diagnostic (plot 608). The controller may be put into a sleep mode at time t5 and then reawakened at time t6 to recheck whether the engine diagnostic may be executed.

For example, at time t6, the controller rechecks human proximity and ambient noise level around the vehicle. In response to detecting human activity within the threshold distance T3 of the vehicle (plot 604) and the determined ambient noise level being greater than the second threshold T2 but less than the first threshold T1 (plot 606), the controller executes the engine diagnostic while duty cycling the pump (and/or actuators) during the diagnostic (plot 608). Specifically, instead of running the pump continuously during the diagnostic, between times t6 and t7, the controller operates the pump by cycling the pump on and off at a duty cycle rate. Between times t6 and t7, the duty cycle rate of the pump is adjusted as human proximity to the vehicle changes (plots 608 and 604). For example, as the detected human activity gets closer to the vehicle, the duty cycle rate increases and/or the duty cycle is adjusted so that the pump is off for a longer period than it is on during each cycle.

As illustrated by examples herein, the method of operating and performing actions responsive to a determination of a first condition may include operating in that first condition (e.g., operating the vehicle while keyed off or while running, while ambient noise is greater than a first threshold), determining whether that first condition is present (such as based on sensor output, e.g., determining that the ambient noise level is greater than the first threshold based on signals received from a microphone of the vehicle, another vehicle parked proximate to the vehicle, or an auxiliary monitoring system in an area of the vehicle) and performing actions in response thereto, as well as operating in a second condition (e.g., operating the vehicle while keyed off or while running, while ambient noise is less than the first threshold), determining that the second condition is present, and performing a different action in response thereto. For example, an engine diagnostic (such as an evaporative emissions diagnostic) may be conducted in response to a determined, first amount of noise proximate to (e.g., within a threshold distance of) the vehicle being greater than a predetermined threshold in a first condition, and the engine diagnostic may be conducted in response to the first amount of noise being less than the predetermined threshold in a second condition, where the first condition includes an indication of human activity within a predetermined proximity of the vehicle and the second condition includes an indication of the human activity not within the predetermined proximity of the vehicle. In another example, an engine diagnostic may be conducted by operating a pump, but not cycling the pump during operation, in response to a determined amount of noise proximate to the vehicle being greater than a first threshold (first condition); and the engine diagnostic may be conducted by operating the pump, while cycling the pump at a duty cycle during operation, in response to the determined amount of noise being greater than a second threshold and less than the first threshold (second condition), where the first threshold is greater than the second threshold.

In this way, an engine diagnostic for a vehicle may be executed (or not executed) based on a determination of whether human activity is occurring proximate to the vehicle and whether ambient noise surrounding the vehicle is above a predetermined threshold. For example, if human activity is detected close to the vehicle and ambient noise is greater than the predetermined threshold, a controller of the vehicle may execute the desired engine diagnostic. However, if the ambient noise is less than the predetermined threshold while human activity is detected, the controller may not execute the diagnostic and wait until either no human activity is detected or when the ambient noise level is greater than the predetermined threshold. The ambient noise level and human proximity may be determined based on signals received from one or more autonomous vehicle sensors of the vehicle or a nearby vehicle (or, in alternative embodiments, and auxiliary monitoring system in an area or location of the vehicle). In this way, an engine diagnostic may be run only under conditions where a human may not hear the noise or be bothered by the noise generated during running of the diagnostic. Further, operation of diagnostic equipment used to execute the diagnostic routine may be controlled during execution of the diagnostic routine in order to reduce noise to a level that is below the ambient noise level. As a result, diagnostic noise may be decreased and customer (e.g., vehicle owner) satisfaction may be increased. The technical effect of conducting an engine diagnostic, including operating one or more of a pump and motor of the vehicle, responsive to a determined ambient noise level that is based on data received from autonomous vehicle sensors is reducing an amount of noise heard by a human proximate to the vehicle while running an engine diagnostic.

As one embodiment, a method for a vehicle, comprises: receiving data from autonomous vehicle sensors; determining an ambient noise level surrounding the vehicle based on the received data; and conducting an engine diagnostic, including operating one or more of a pump and motor of the vehicle, responsive to the determined ambient noise level. In a first example of the method, the method further comprises determining a proximity of human activity to the vehicle, while the vehicle is parked and an engine of the vehicle is off, based on the received data and conducting the engine diagnostic responsive to the determined proximity being within a threshold distance of the vehicle and the determined ambient noise level being greater than a first threshold. A second example of the method optionally includes the first example and further includes, wherein conducting the engine diagnostic responsive to the determined proximity being within the threshold distance of the vehicle and the determined ambient noise level being greater than the first threshold includes operating the one or more of the pump and motor without cycling the one or more of the pump and motor for a duration of the engine diagnostic. A third example of the method optionally includes one or more of the first and second examples, and further includes conducting the engine diagnostic via operating the one or more of the pump and motor and duty cycling the pump and/or motor at a duty cycle rate responsive to the determined proximity being within the threshold distance of the vehicle and the determined ambient noise level being greater than a second threshold, the second threshold less than the first threshold. A fourth example of the method optionally includes one or more of the first through third examples, and further includes adjusting the duty cycle rate as the determined proximity changes during conducting the engine diagnostic. A fifth example of the method optionally includes one or more of the first through fourth examples, and further includes not conducting the engine diagnostic responsive to the determined proximity being within the threshold distance of the vehicle and the determined ambient noise level being less than the second threshold. A sixth example of the method optionally includes one or more of the first through fifth examples, and further includes, conducting the engine diagnostic responsive to the determined proximity being greater than the threshold distance. A seventh example of the method optionally includes one or more of the first through sixth examples, and further includes, determining an internal noise level of the vehicle, inside the vehicle, based on the received data and conducting the engine diagnostic, while an engine of the vehicle is running, responsive to a sum of the ambient noise level and internal noise level being greater than a first threshold. An eighth example of the method optionally includes one or more of the first through seventh examples, and further includes not conducting the engine diagnostic, while the engine is running, responsive to the sum of the ambient noise level and internal noise level being less than the threshold. A ninth example of the method optionally includes one or more of the first through eighth examples, and further includes, wherein the autonomous vehicle sensors are part of the vehicle in which the engine diagnostic is conducted. A tenth example of the method optionally includes one or more of the first through ninth examples, and further includes, wherein the autonomous vehicle sensors are part of a vehicle located proximate to the vehicle in which the engine diagnostic is conducted. An eleventh example of the method optionally includes one or more of the first through tenth examples, and further includes, wherein the autonomous vehicle sensors include one or more cameras or vision sensors and a microphone. An eleventh example of the method optionally includes one or more of the first through tenth examples, and further includes, wherein the engine diagnostic is an evaporative emissions diagnostic for an evaporative emissions system of an engine of the vehicle and wherein conducting the engine diagnostic includes operating a vacuum pump at an on/off duty cycle that is determined based on the determined ambient noise level.

As another embodiment, a method for a vehicle, comprises: conducting an evaporative emissions diagnostic by operating a pump, but not cycling the pump during operation, in response to a determined amount of noise proximate to the vehicle being greater than a first threshold; and conducting the evaporative emissions diagnostic by operating the pump, while cycling the pump at a duty cycle during operation, in response to the determined amount of noise being greater than a second threshold and less than the first threshold, where the first threshold is greater than the second threshold. In a first example of the method, the method further comprises adjusting the duty cycle, during conducting the evaporative emissions diagnostic, based on an estimate of a proximity of detected human activity to the vehicle, where the proximity is determined based on data received from one or more autonomous vehicle sensors. A second example of the method optionally includes the first example and further includes, wherein the determined amount of noise proximate to the vehicle is determined based on data received at a controller of the vehicle from one or more sensors of an autonomous vehicle, where the autonomous vehicle is one of the vehicle in which the controller is installed or an autonomous vehicle located nearby the vehicle in which the controller is installed. A third example of the method optionally includes one or more of the first and second examples, and further includes not conducting the evaporative emissions diagnostic in response to the determined amount of noise being less than the second threshold.

As yet another embodiment, a system for a vehicle, comprises: a controller with computer readable instructions stored on non-transitory memory that when executed during a vehicle key-off condition, cause the controller to: determine a first amount of noise proximate to the vehicle; conduct an evaporative emissions system diagnostic in response to the first amount of noise being greater than a predetermined threshold in a first condition; and conduct the evaporative emissions system diagnostic in response to the first amount of noise being less than the predetermined threshold in a second condition. In a first example of the system, the first condition includes an indication of human activity within a predetermined proximity of the vehicle and the second condition includes an indication of the human activity not within the predetermined proximity of the vehicle. A second example of the system optionally includes the first example and further includes an evaporative emissions system including a fuel vapor canister and a pump, wherein conducting the evaporative emissions system diagnostic in the first condition includes operating the pump at a duty cycle and adjusting the duty cycle as a determined proximity of human activity to the vehicle changes, and wherein the first amount of noise is determined based on data received at the controller from one or more cameras included in one or more of the vehicle, a nearby vehicle parked within a threshold distance of the vehicle, and an auxiliary monitoring system arranged in an area in which the vehicle is parked.

In another representation, a method for a vehicle comprises: a duration after key-off, waking a controller of the vehicle and conducting an evaporative emissions diagnostic in response to a determined ambient noise level surrounding the vehicle and detection of human activity within a threshold distance of the vehicle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a vehicle, comprising:

receiving data from autonomous vehicle sensors;

determining an ambient noise level surrounding the vehicle based on the received data;

conducting an engine diagnostic, including operating one or more of a pump and motor of the vehicle, responsive to the determined ambient noise level; and determining a proximity of human activity to the vehicle, while the vehicle is parked and an engine of the vehicle is off, based on the received data and conducting the engine diagnostic responsive to a determined proximity being within a threshold distance of the vehicle and the determined ambient noise level being greater than a first threshold, the first threshold greater than a second threshold.

2. The method of claim 1, wherein conducting the engine diagnostic responsive to the determined proximity being within the threshold distance of the vehicle and the determined ambient noise level being greater than the first threshold includes operating the one or more of the pump and motor without cycling the one or more of the pump and motor for a duration of the engine diagnostic.

3. The method of claim 2, further comprising conducting the engine diagnostic via operating the one or more of the pump and motor and duty cycling the pump and/or motor at a duty cycle rate responsive to the determined proximity being within the threshold distance of the vehicle and the determined ambient noise level being greater than the second threshold.

4. The method of claim 3, further comprising adjusting the duty cycle rate as the determined proximity changes during conducting the engine diagnostic.

5. The method of claim 3, further comprising not conducting the engine diagnostic responsive to the determined proximity being within the threshold distance of the vehicle and the determined ambient noise level being less than the second threshold.

6. The method of claim 1, further comprising conducting the engine diagnostic responsive to the determined proximity being greater than the threshold distance.

7. The method of claim 1, further comprising determining an internal noise level of the vehicle, inside the vehicle, based on the received data and conducting the engine diagnostic, while an engine of the vehicle is running, responsive to a sum of the ambient noise level and internal noise level being greater than a first threshold.

8. The method of claim 7, further comprising not conducting the engine diagnostic, while the engine is running, responsive to the sum of the ambient noise level and internal noise level being less than the threshold.

9. The method of claim 1, wherein the autonomous vehicle sensors are part of the vehicle in which the engine diagnostic is conducted.

10. The method of claim 1, wherein the autonomous vehicle sensors are part of a vehicle located proximate to the vehicle in which the engine diagnostic is conducted.

11. The method of claim 1, wherein the autonomous vehicle sensors include one or more cameras or vision sensors and a microphone.

12. The method of claim 1, wherein the engine diagnostic is an evaporative emissions diagnostic for an evaporative emissions system of an engine of the vehicle and wherein conducting the engine diagnostic includes operating a vacuum pump at an on/off duty cycle that is determined based on the determined ambient noise level.

13. A method for a vehicle, comprising:

conducting an evaporative emissions diagnostic by operating a pump, but not cycling the pump during operation, in response to a determined amount of noise proximate to the vehicle being greater than a first threshold; and conducting the evaporative emissions diagnostic by operating the pump, while cycling the pump at a duty cycle during operation, in response to the determined amount of noise being greater than a second threshold and less than the first threshold, where the first threshold is greater than the second threshold.

14. The method of claim 13, further comprising adjusting the duty cycle, during conducting the evaporative emissions diagnostic, based on an estimate of a proximity of detected human activity to the vehicle, where the proximity is determined based on data received from one or more autonomous vehicle sensors.

15. The method of claim 13, wherein the determined amount of noise proximate to the vehicle is determined based on data received at a controller of the vehicle from one or more sensors of an autonomous vehicle, where the autonomous vehicle is one of the vehicle in which the controller is installed or an autonomous vehicle located nearby the vehicle in which the controller is installed.

16. The method of claim 13, further comprising not conducting the evaporative emissions diagnostic in response to the determined amount of noise being less than the second threshold.

17. A system for a vehicle, comprising:

a controller with computer readable instructions stored on non-transitory memory that when executed during a vehicle key-off condition, cause the controller to:

determine a first amount of noise proximate to the vehicle;

conduct an evaporative emissions system diagnostic in response to the first amount of noise being greater than a predetermined threshold in a first condition; and conduct the evaporative emissions system diagnostic in response to the first amount of noise being less than the predetermined threshold in a second condition.

18. The system of claim 17, wherein the first condition includes an indication of human activity within a predetermined proximity of the vehicle and the second condition includes an indication of the human activity not within the predetermined proximity of the vehicle.

19. The system of claim 17, further comprising an evaporative emissions system including a fuel vapor canister and a pump, wherein conducting the evaporative emissions system diagnostic in the first condition includes operating the pump at a duty cycle and adjusting the duty cycle as a determined proximity of human activity to the vehicle changes, and wherein the first amount of noise is determined based on data received at the controller from one or more cameras included in one or more of the vehicle, a nearby vehicle parked within a threshold distance of the vehicle, and an auxiliary monitoring system arranged in an area in which the vehicle is parked.

* * * * *